United States Patent [19]

Falk

[11] 3,961,507

[45] June 8, 1976

[54] RESETTABLE AXIAL PIN TUMBLER LOCK

[75] Inventor: Morris Falk, Palm Springs, Calif.

[73] Assignee: Fork Lock Corporation, River Grove, Ill.

[22] Filed: Jan. 17, 1975

[21] Appl. No.: 542,039

[52] U.S. Cl. ..... 70/363; 70/383

[51] Int. Cl.[2] ..... E05B 25/00

[58] Field of Search ..... 70/363, 382, 383, 384, 70/385, 386, 182; 292/75, 252

[56] References Cited

UNITED STATES PATENTS

| | | | |
|---|---|---|---|
| 1,417,132 | 5/1922 | Baker | 70/386 X |
| 3,411,331 | 11/1968 | Schlage | 70/363 |
| 3,648,492 | 3/1972 | Walters | 70/363 |
| 3,756,049 | 9/1973 | Kerr | 70/363 |

FOREIGN PATENTS OR APPLICATIONS

| | | | |
|---|---|---|---|
| 405,978 | 1966 | Switzerland | 70/182 |

*Primary Examiner*—Robert L. Wolfe

*Attorney, Agent, or Firm*—Leydig, Voit, Osann, Mayer & Holt, Ltd.

[57] ABSTRACT

A resettable axial pin tumbler lock having a spindle rotatably mounted in a barrel with the spindle and barrel forming a "lock" radial interface and a plurality of cooperating axial wells for receiving axial pins. A plurality of driver pins are disposed in the wells in the barrel and spring biased across the "lock" interface into the wells of the spindle to lock the spindle against rotation in the barrel. A reset ring is rotatably mounted in the barrel with the reset ring and the spindle forming a "reset" radial interface and a plurality of cooperating axial wells for receiving axial pins. A plurality of reset pins are disposed in the wells in the spindle and reset ring in axial alignment and engagement with the driver pins so that the spring bias on the driver pins also applies a biasing force to the reset pins. To unlock the lock, a service key engages the reset pins and axially displaces both the reset pins and the driver pins against the spring bias to align the radial interfaces between the two sets of pins with the "lock" interface. To reset the lock, a reset key engages the reset pin and axially displaces both sets of pins to align the radial interfaces between the pins with the "reset" interface to permit rotation of the reset ring relative to the spindle while locking the spindle to the barrel. The reset pins have different axial lengths so that rotation of the reset ring relative to the spindle and drive pins changes the combination of axial pin displacements required to align the pin interfaces with the "lock" interface. A detent mechanism is provided between the reset ring and the spindle to indicate when the reset ring is in a position where its axial pin wells are in alignment with the pin wells in the spindle and the barrel.

6 Claims, 10 Drawing Figures

NORMAL POSITIONS

UNLOCK POSITIONS

RESET POSITIONS

NORMAL POSITIONS AFTER BEING RESET

RESETTABLE AXIAL PIN TUMBLER LOCK

DESCRIPTION OF THE INVENTION

The present invention relates generally to tubular pin tumbler locks and, more particularly, to the resetting of such locks so that different service keys are required to operate the lock.

In U.S. Pat. No. 3,756,049 to W.J. Kerr, there is described a resettable tubular pin tumbler lock utilizing a reset cylinder and a special set of reset tumblers, in addition to the conventional "driver" tumblers and "follower" tumblers. This means that each tumbler is actually a series of three segments, which requires that at least certain of the segments be relatively short (unless the entire lock is made longer, which is not desirable). Because of the shorter tumbler sections, there is an increased likelihood of the lock becoming jammed, due to tilting and catching of the short tumbler sections, for example, downgrading the reliability of the lock. Furthermore, the use of the three-section tumblers obviously requires an increase in the number of parts required to manufacture the locks.

It is a primary object of the present invention to provide an improved resettable tubular pin tumbler lock which has a high degree of reliability, and which is not susceptible to jamming.

Another object of this invention is to provide such an improved resettable tubular pin tumbler lock which requires a relatively small number of parts and, therefore, can be efficiently and economically manufactured.

A further object of the present invention is to provide such an improved resettable tubular pin tumbler lock which facilitates resetting of the lock by providing a positive indication of the location of the reset key.

Other objects and advantages of the invention will be apparent from the following detailed description and the accompanying drawings, in which.

Figure 1:
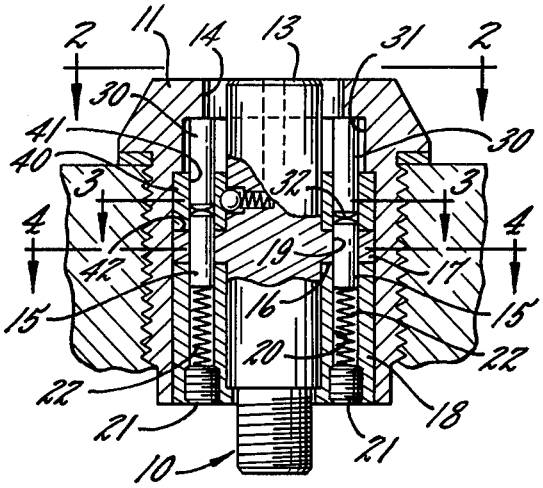
FIG. 1 is a vertical section of a tubular pin tumbler lock embodying the invention.
Figure 2:
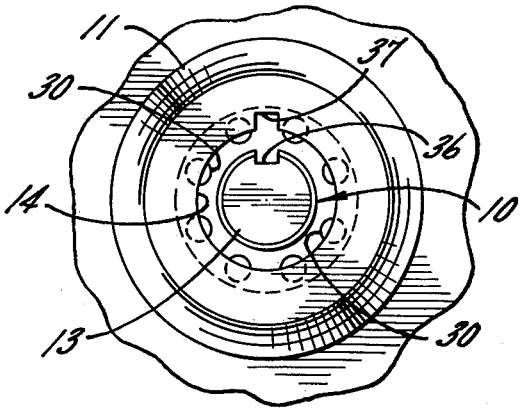
FIG. 2 is a plan view of the lock of FIG. 1 taken along line 2—2 in FIG. 1.

While the invention will be described herein in connection with certain preferred embodiments, it is to be understood that it is not intended to limit the invention to these particular embodiments. To the contrary, the intention is to cover all alternatives, modifications and equivalents within the spirit and scope of the invention as defined by the appended claims.

Turning to the drawings and referring first to FIGS. 1–4, there is shown a tubular pin tumbler lock having a spindle 10 journaled inside a barrel 11. One end 12 of spindle 10 is threaded for connection to a latch element (not shown) controlled by the lock, while the other end 13 extends through the forward end of the barrel 11 to form an annular keyway 14 for receiving a tubular key to lock the spindle 10 to the barrel 11, a plurality of driver pins 15 extend across the interface 16 between an enlarged central portion 17 of the spindle 10 and a sleeve 18 pressed into the rear body portion of the barrel 11, to prevent rotation of the spindle 10 relative to the barrel 11. More specifically, the driver pins 15 are disposed in circumferentially spaced holes or wells 19 extending axially through the spindle portion 17, and corresponding wells 20 formed in the sleeve 18. To seal the driver pins inside the lock, plugs 21 are threaded into the outer ends of the wells 20, and small coil springs 22 are disposed within the wells between the inner ends of the plugs 21 and the rear ends of the driver pins 15 to bias the pins 15 toward the forward end of the lock and into the spindle wells 19. Although the enlarged central portion 17 has been illustrated as an integral part of the spindle 10, it will be understood that it could be formed by a separate ring keyed to the spindle shaft.

To effect unlocking of the spindle 10 from the barrel 11, a second pin 30 (referred to herein as the "reset" pin for reasons which will become apparent from the ensuing discussion) is disposed in each well 19 and extends forwardly therefrom into an annular cavity 31 formed by the barrel 11 around the outer periphery of the keyway 14 at the inner end thereof. The biasing force exerted on the driver pins 15 by the springs 22 normally urges the reset pins 30 against the forward end wall of the cavity 31, thereby positioning the driver pins 15 across the interface 16 to lock the spindle 10 to the barrel 11. However, when a key is inserted into the keyway 14, the key depresses both the reset pins 30 and the driver pins 15 until the interface 32 between each cooperating pair of the pins 30 and 15 is aligned with the spindle-barrel interface 16, thereby permitting rotation of the spindle 10 within the barrel 11. To permit operation of the lock by only selected keys, the pins 30 have different lengths, so that for any given combination of pin lengths the lock can be unlocked only by a key or keys having a corresponding combination of notch depths, as is well known in this art.

Figure 5:
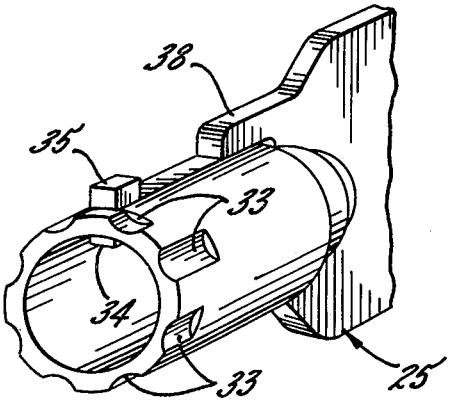
FIG. 5 is a perspective view of a service key for operating the lock of FIG. 1.

In FIG. 5, there is illustrated a typical service key 25 for the lock of FIGS. 1–4. In order to provide the required orientation of the key notches 33 relative to the pins 30, the key includes a pair of tabs 34 and 35 projecting radially from the inner and outer surfaces, respectively, at the forward end of the key. These tabs are adapted to fit into a corresponding pair of grooves 36 and 37 formed by the spindle 10 and the barrel 11, respectively, on opposite sides of the keyway 14. To insert the key into the keyway 14, the tabs 34 and 35 must be aligned with the grooves 36 and 37, thereby insuring proper orientation of the key notches 33 relative to the pins 30. To facilitate alignment of the tabs 34 and 35 with the grooves 36 and 37 when it is desired to remove the key from the lock, a pointer 38 aligned with the tabs 34 and 35 is formed on the key handle. When the key is in its fully advanced position in the lock, the outer tab 35 is positioned within the cavity 31 so that it does not interfere with rotation of the key 25 and spindle 10 relative to the barrel 11, while the inner tab 34 remains keyed to the spindle 10 to be rotated by the key. To remove the service key 25 from the lock, the tab 35 must be realigned with the groove 37, thereby ensuring that each reset pin 30 is always aligned with the proper driver pin 15 before the service key is removed from the lock.

In accordance with the present invention, a reset ring is rotatably mounted in the barrel and forms a plurality of axial wells cooperating with the wells in the spindle for receiving the reset pins, with the reset ring and the spindle forming a second radial interface which is used for resetting the lock. Thus, in the illustrative embodiment, a reset ring 40 is rotatably mounted on the forward end 13 of the spindle and engaging the front surface of the enlarged central portion 17 of the spindle. This ring 40 forms a plurality of wells 41 which hold the reset pins 30 in axial alignment and direct engagement with the driver pins 15, with the spring bias on the driver pins urging the reset pins against the forward wall of the cavity 31. Thus, it can be seen that there are two radial interfaces at which alignment of all the pin interfaces 32 will permit angular movement of the reset pins 30 relative to the driver pins 15. The first such radial interface is the conventional "lock" interface 16 between the barrel sleeve 18 and spindle portion 17. This is the interface at which all the pin interfaces 32 are aligned when the proper service key is in inserted into the lock, thereby permitting rotation of the spindle and the reset ring relative to the barrel. The second such radial interface is the "reset" interface 42 between the reset ring 40 and the spindle portion 17. When the pin interfaces 32 are all aligned with this second radial interface 42, the spindle remains locked to the barrel by the driver pins 15, but the reset ring 40 can be rotated to move all the reset pins 30 into axial alignment with the driver pins 15 at different angular positions so that different service keys are required to operate the lock. This is referred to as a "resetting" of the lock.

Figure 6:
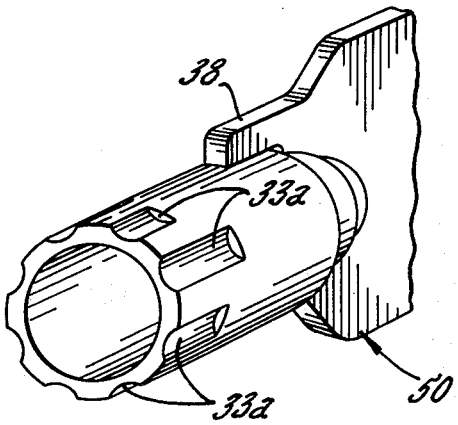
FIG. 6 is a perspective view of a reset key for resetting the lock of FIG. 1.

To carry out the resetting function, a reset key 50 as shown in FIG. 6 is employed. This reset key 50 is similar to the service key 25 shown in FIG. 5, except that all the notches 33a in the reset key are deeper than the notches 33 in the service key by a distance equal to the axial thickness of the spindle portion 17. This causes the reset key to position the pin interfaces 32 at the "reset" interface 42 rather than the "lock" interface 16. In addition, the reset key 50 does not have the lugs 34 and 35 provided on the service key to ensure that the service key is always inserted into the lock at the same angular position relative to the pins. Consequently, the reset key can be inserted and removed from the lock at any desired angular position, so that the reset ring 40 and the reset pins 30 can be moved to any desired angular position and then left at that position by removal of the reset key without returning it to its starting position.

To facilitate the resetting operation, numbers or other indicia may be provided on the face of the lock to indicate the different positions of the pins. For example, in the illustrative embodiment the lock contains eight sets of pins, so there are eight different possible positions at which the reset pins can be located.

Figure 3:
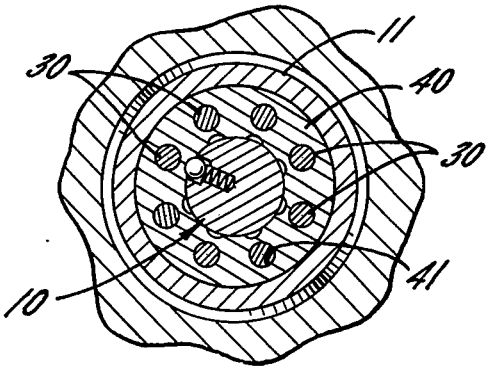
FIG. 3 is a section taken along line 3—3 in FIG. 1.
Figure 4:
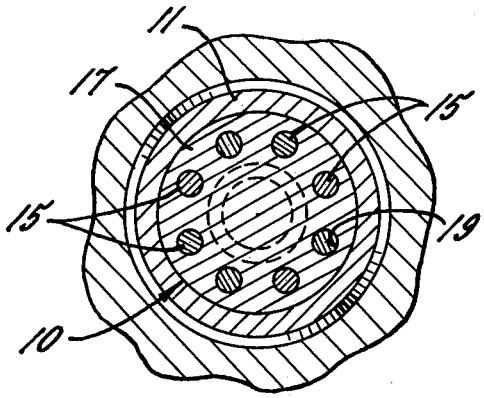
FIG. 4 is a section taken along line 4—4 in FIG. 1.

In accordance with a further aspect of the invention, a detent responds to rotation of the reset ring to indicate each position of alignment of the reset pins with the driver pins. Thus, as shown in FIGS. 1 and 3, the illustrative lock includes a plurality of recesses 60 formed in the radially inner surface of the reset ring 40 in alignment with the axial pin well 41 in the reset ring. These recesses 60 receive a detent ball 61 mounted for radial movement in the radially outer surface of the spindle shaft 13 and biased outwardly against the inner surface of the reset ring by means of a spring 62. The detent ball 61 is radially aligned with one of the axial pin wells 19 in the spindle portion 17, so the detent ball 61 will snap into one of the recesses 60 only when the axial pin wells 41 in the reset ring 40 are aligned with the axial pin wells in the spindle. In the illustrative embodiment, there are a total of eight pins and pin wells, and so there are eight recesses 60 representing eight different reset positions. It will be appreciated that when a reset key is inserted in the lock and turned, the user will be able to feel and hear the detent ball 61 snapping into the recesses 60 at the various reset positions. Of course, the reset key should be removed from the lock only when it is in one of the eight detent positions; otherwise the lock will be inoperable when the reset key is removed.

To more specifically illustrate how the resetting operation is performed, one particular combination of reset pins 30 and driver pins 15 is illustrated in linear form in FIGS. 7–10, in different operative states. The eight reset pins 30 have been identified by numbers 1 through 8 on the pins, while the driver pins 15 have been identified by the letters A through H on the pins. In the particular arrangement illustrated, the driver pins 15 have been illustrated with a constant axial length, while the reset pins 30 have varying lengths, but it will be appreciated that the driver pins 15 could also be varying lengths if desired to achieve a larger number of different combinations. Moreover, an even larger number of combinations may be achieved by use of the stepped pins described in U.S. Pat. No. 3,738,136 to Morris Falk, which is assigned to the assignee of the present invention.

Figure 7:
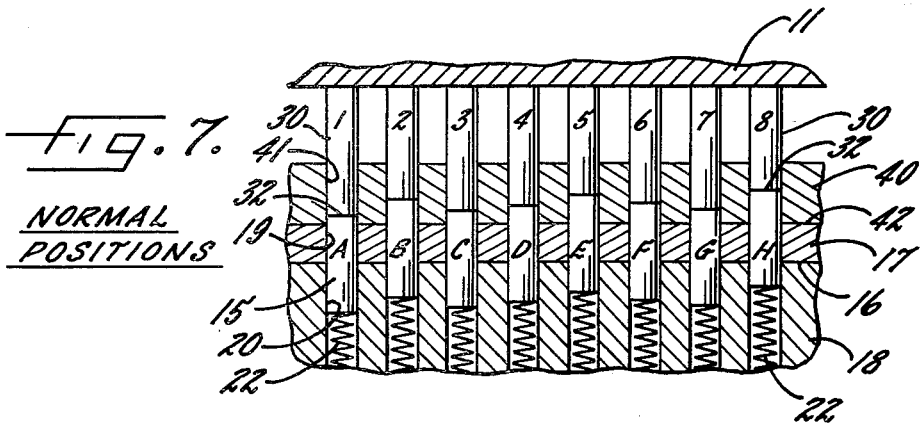
FIG. 7 is a linear illustration of a randomly selected combination of tumbler pins in their fully locked positions.
Figure 8:
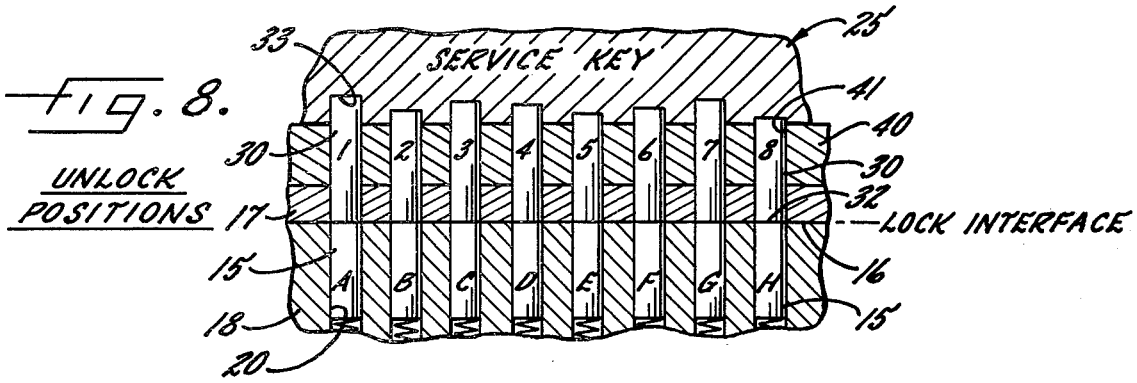
FIG. 8 is a linear illustration of the same combination of tumbler pins shown in FIG. 7 in their unlocked positions, i.e., with an operative service key inserted in the lock.

In FIG. 7, the pins are illustrated in a normal locked condition, i.e., with the driver pins 15 extending through both radial interfaces 16 and 42 to prevent rotation of both the spindle 10 or the reset ring 40 relative to the barrel sleeve 18. In FIG. 8, the pins are illustrated with a service key 25 inserted in the lock. It can be seen that the notches 33 in the service key depress the pins 30 and 15 by different amounts so that the pin interfaces 32 are all brought into alignment with the lock interface 16 between the barrel sleeve 18 and the spindle portion 17. When the pins are in this position, the spindle 10 can be rotated relative to the barrel 11 for normal unlocking and locking operation of the lock.

Figure 9:
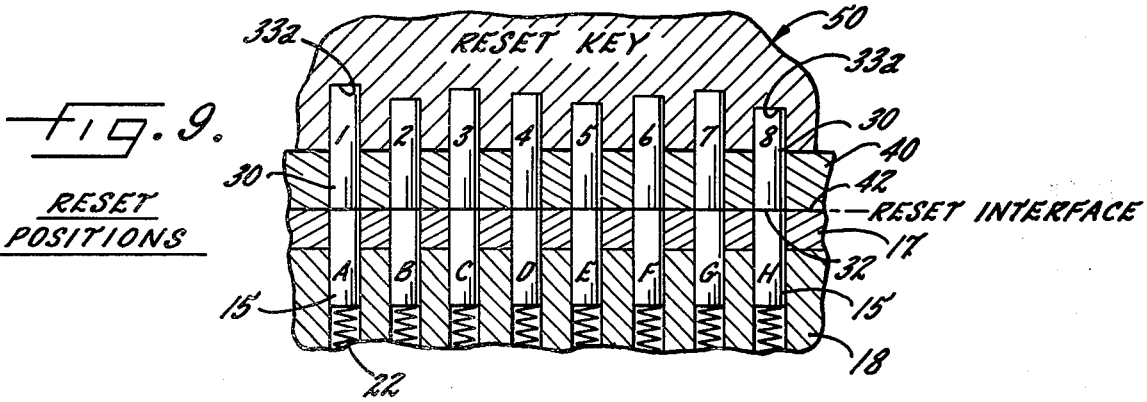
FIG. 9 is a linear illustration of the same combination of tumbler pins shown in FIG. 6 in their reset positions, i.e., with a reset key inserted in the lock.
Figure 10:
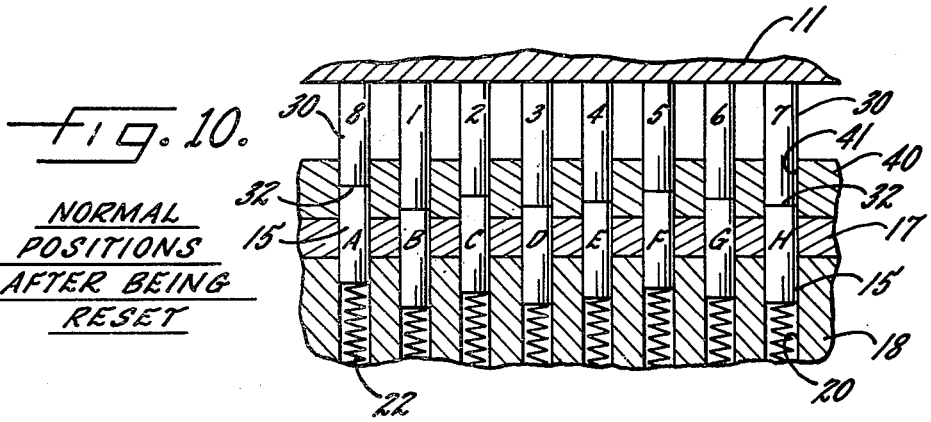
FIG. 10 is a linear illustration of the same combination of tumbler pins shown in FIG. 6 in a reset position, i.e., with the reset pins shifted one pin position to the right.

In FIG. 9, the pins are illustrated with a reset key 50 inserted in the lock. Since the recesses **33*a* in the reset key are deeper than the recesses 33 in the service key by a distance equal to the axial thickness of the spindle portion 17, the reset key 50 brings the pin interfaces 32 into alignment with the reset interface 42 between the spindle portion 17 and the reset ring 40. When the pins are in this position, the spindle and barrel are locked, but the reset ring 40 can be rotated relative to the spindle and barrel. This permits the eight reset pins 1–8, which have different lengths, to be rotated to a different angular position relative to the eight drive pins A–H, which always remain at the same angular position. For example, if the reset pins are rotated 45°, which represents the distance between one pair of adjacent pin positions, the reset pins 30 are reset to the positions illustrated in FIG. 10 (shown with no key inserted in the lock). That is, the reset pins 1–7 have been shifted from alignment with drive pins A–G to alignment with drive pins B–H, while reset pin 8 is shifted into alignment with drive pin A. Thus, it can be seen that a different service key will be required to operate the lock with the pins 30 in the reset position illustrated in FIG. 10, because the service key is always inserted into the lock with a constant orientation of the key notches relative to the reset pins due to the registering function of the lugs 34 and 35.**

As can be seen from the foregoing detailed description, this invention provides a resettable tubular pin tumbler lock having only two sets of tumbler pins, namely the reset pins and the drive pins. Consequently, for any given lock length, each of the pins can have a relatively long axial length so that the lock is not susceptible to jamming, thereby providing a high degree of reliability. Furthermore, the lock requires only a relatively small number of parts, so that it can be efficiently and economically manufactured. The detent mechanism facilitates resetting of the lock by providing a positive indication of the location of the reset key.

I claim as my invention:

1. A resettable axial pin tumbler lock comprising, a. axially movable pins consisting solely of first and second sets of pins, b. a spindle rotatably mounted in a barrel with the spindle and barrel forming a first radial interface and a plurality of cooperating axial wells for receiving the first set of axial pins, c. the first set of pins being a plurality of driver pins disposed in the wells in said barrel and spring biased across said radial interface into the wells in said spindle to lock said spindle against rotation in said barrel, d. a reset ring rotatably mounted in said barrel with the reset ring and the spindle forming a second radial interface and a plurality of cooperating axial wells for receiving the second set of axial pins, e. said second set of pins being a plurality of reset pins disposed in the wells in said spindle and reset ring in axial alignment and engagement with said driver pins so that the spring bias on the driver pin also applies a biasing force to the reset pins, f. said spindle and barrel forming a narrow annular keyway for receiving a tubular key for engaging said reset pins and axially displacing both the reset pins and the driver pins against the spring bias on said driver pins to align the radial interfaces between the reset pins and driver pins either with the reset ring-spindle interface to permit rotation of the reset ring relative to the spindle while locking the spindle to the barrel, or with the spindle-barrel interface to permit rotation of the spindle relative to the barrel while locking the spindle to the reset ring, g. said reset pins having a preselected combination of different axial lengths so that rotation of the reset ring, when all the pin interfaces are aligned with the reset ring-spindle interface, changes the combination of axial pin displacements required to align all the pin interfaces with the spindle-barrel interface.

2. An axial pin tumbler as set forth in claim 1 which includes a detent responsive to rotation of the reset ring for indicating each position of alignment of the reset pins with the driver pins.

3. An axial pin tumbler lock as set forth in claim 2 wherein the reset disc is rotatably mounted around a shaft formed by the spindle, and said detent comprises a plurality of recesses formed in the radially inner surface of the reset ring in alignment with the axial pin wells in the reset ring, and a detent member mounted for radial movement in the radially outer surface of the spindle shaft and biased outwardly against the inner surface of the reset ring so that the detent member snaps into one of said recesses whenever an axial pin well in the reset ring is aligned with the detent member, said detent member being radially aligned with one of the axial pin wells in the spindle.

4. An axial pin tumbler lock as set forth in claim 1 wherein said driver pins have a preselected combination of different axial lengths.

5. In a resettable axial pin tumbler lock, the improvement comprising a spindle and barrel containing axially movable pins consisting solely of two sets of pins, the first set being a plurality of driver pins for locking the spindle and barrel together, a rotatable reset ring containing the second set of pins being a plurality of axially movable reset pins in axial alignment and engagement with the driver pins, the reset pins having a preselected combination of different axial lengths and being movable between one of two different interfaces so that only a preselected service key will operate the lock at any given angular position of the reset ring, the reset ring being rotatable relative to the spindle for moving the reset pins into axial alignment with the driver pins at different angular positions so that different service keys are required to operate the lock.

6. A method of resetting an axial pin tumbler lock for operation by any of a plurality of different service keys, said method comprising the steps of a. providing the lock with a rotatable reset ring containing two sets of a plurality of axially movable pins, said pins consisting solely of one set of reset pins in axial alignment and engagement with a set of the standard driver pins and movable between either one of two different interfaces which lock the spindle to the barrel of the lock, the reset pins having a preselected combination of different axial lengths so that only a selected one of the service keys will operate the lock, b. and resetting the lock by moving the reset pins into axial alignment with the other of the interfaces and rotating the reset ring to move the reset pins into axial alignment with the driver pins at a different angular position so that a different service key is required to operate the lock.

* * * * *